US005154309A

United States Patent [19]

Wischusen, III et al.

[11] Patent Number: 5,154,309

[45] Date of Patent: Oct. 13, 1992

[54] INSULATING BLANKET FOR SHIPPING CONTAINER HAVING SCORED MINERAL WOOL

[75] Inventors: Henry Wischusen, III; Larry Clark, both of Lilburn, Ga.

[73] Assignee: Rock-Tenn Company, Norcross, Ga.

[21] Appl. No.: 638,343

[22] Filed: Jan. 7, 1991

[51] Int. Cl.[5] ..... B65D 5/60

[52] U.S. Cl. ..... 220/403; 220/410; 220/429; 220/470; 428/76; 428/167

[58] Field of Search ..... 220/3.1, 400, 403, 408, 220/410, 429, 470; 428/76, 167; 206/521, 523, 594; 383/4, 110, 120, 75; 229/23 R, DIG. 4

[56] References Cited

U.S. PATENT DOCUMENTS

| | | | |
|---|---|---|---|
| 546,767 | 9/1895 | Knobeloch . | |
| 742,159 | 10/1903 | Burton . | |
| 930,953 | 8/1909 | Freund . | |
| 1,146,307 | 7/1915 | Butler . | |
| 1,264,497 | 4/1918 | Field . | |
| 1,307,638 | 6/1919 | Pridham . | |
| 1,352,833 | 9/1920 | Robinson . | |
| 1,364,839 | 1/1921 | Gereke . | |
| 1,400,060 | 12/1921 | Heim . | |
| 1,704,175 | 3/1929 | Coale . | |
| 2,008,420 | 7/1935 | Howard . | |
| 2,087,966 | 7/1937 | Clark . | |
| 2,307,720 | 1/1943 | Ringler . | |
| 2,456,841 | 12/1948 | Rushing . | |
| 2,556,321 | 6/1951 | Denton . | |
| 2,632,723 | 3/1953 | Bennett . | |
| 2,711,282 | 6/1955 | D'esposito . | |
| 2,770,406 | 11/1956 | Lane . | |
| 2,837,261 | 6/1958 | Stenger . | |
| 2,856,114 | 10/1958 | Guyer . | |
| 2,915,235 | 12/1959 | Rueckert . | |
| 2,954,913 | 10/1960 | Rossman . | |
| 2,967,654 | 1/1961 | Palmer . | |
| 2,982,464 | 5/1961 | Wingate . | |
| 3,031,121 | 4/1962 | Chase | 383/110 |
| 3,038,463 | 6/1962 | Daymon . | |
| 3,194,480 | 7/1965 | Maindron . | |
| 3,227,352 | 1/1966 | Striplin et al. . | |
| 3,264,165 | 8/1966 | Stickel | 428/71 |
| 3,306,516 | 2/1967 | Taylor, Jr. . | |
| 3,344,973 | 10/1967 | Studen . | |
| 3,348,756 | 10/1967 | Boysen . | |
| 3,393,859 | 7/1968 | Giummo . | |
| 3,412,521 | 11/1968 | Bauman | 493/100 |
| 3,567,106 | 3/1971 | Anderson . | |
| 3,589,971 | 6/1971 | Reed | 383/110 |
| 3,608,811 | 9/1971 | Frick . | |
| 3,615,149 | 10/1971 | Malone et al. | 220/410 |

(List continued on next page.)

FOREIGN PATENT DOCUMENTS

| | | |
|---|---|---|
| 700533 | of 1962 | Canada . |
| 319252 | 7/1989 | European Pat. Off. . |
| 2530-219-A | of 1983 | France . |
| 1456741 | 3/1974 | United Kingdom . |
| 9018668-5 | 5/1990 | United Kingdom . |

*Primary Examiner*—Gary E. Elkins
*Attorney, Agent, or Firm*—Jones, Askew & Lunsford

[57] ABSTRACT

Insulation material is configured to provide improved insulating properties in a shipping container. A sheet of insulation material is placed aong the bottom of a container under the contents of the container. An insulating blanket constructed of plastic sheets sealed around their periphery to form a pouch for containing scored paperboard and scored mineral wool is configured to have an inverted U-shape and is placed over a bottom half of the container. A top half of the container is then placed over the bottom half such that the legs of the inverted U-shaped material are between the overlapping side of top and bottom of the container and the middle portion of the U-shaped material is between the top of the container and the contents within the container. A method of scoring mineral wool positioned between plastic sheets is also provided.

22 Claims, 5 Drawing Sheets

U.S. PATENT DOCUMENTS

| | | | |
|---|---|---|---|
| 3,615,964 | 10/1971 | Malone . | |
| 3,627,541 | 12/1971 | Farquhar . | |
| 3,743,169 | 7/1973 | Person . | |
| 3,756,495 | 9/1973 | Bemiss . | |
| 3,779,447 | 12/1973 | Bemiss . | |
| 3,812,002 | 5/1974 | Lurie | 428/167 |
| 3,863,830 | 2/1975 | Christensson . | |
| 3,866,816 | 2/1975 | Bemiss . | |
| 3,883,068 | 5/1975 | Silver . | |
| 3,890,762 | 6/1975 | Ernst et al. . | |
| 3,902,653 | 9/1975 | Persson . | |
| 3,917,155 | 11/1975 | Bemiss . | |
| 3,964,669 | 6/1976 | Sontag et al. . | |
| 3,972,467 | 8/1976 | Whillock et al. . | |
| 3,990,495 | 11/1976 | Labarba | 220/410 |
| 4,032,060 | 6/1977 | Bergstein . | |
| 4,196,841 | 4/1980 | Smith et al. . | |
| 4,196,843 | 4/1980 | Garmon . | |
| 4,208,007 | 6/1980 | Bamburg et al. . | |
| 4,237,171 | 12/1980 | Laage et al. . | |
| 4,254,173 | 3/1981 | Peer, Jr. . | |
| 4,335,830 | 6/1982 | Garganese . | |
| 4,342,610 | 8/1982 | Ray, Jr. . | |
| 4,363,851 | 12/1982 | Mishina et al. . | |
| 4,401,706 | 8/1983 | Sovilla . | |
| 4,489,112 | 12/1984 | Wise et al. . | |
| 4,544,597 | 10/1985 | Peer, Jr. et al. . | |
| 4,571,340 | 2/1986 | Ferrante et al. . | |
| 4,575,000 | 3/1986 | Gordon et al. . | |
| 4,610,885 | 9/1986 | Tait . | |
| 4,720,015 | 1/1988 | Brauner . | |
| 4,723,700 | 2/1988 | Wischusen, III . | |
| 4,730,748 | 3/1988 | Bane . | |
| 4,738,545 | 4/1988 | Westgor | 383/75 |
| 4,754,914 | 7/1988 | Wischusen, III . | |
| 4,760,949 | 8/1988 | Elias . | |
| 4,777,053 | 10/1988 | Tobelmann et al. . | |
| 4,779,998 | 10/1988 | Wischusen, III . | |
| 4,867,372 | 9/1989 | Patterson | 206/521 |
| 5,009,326 | 4/1991 | Reaves et al. | 220/410 |

101
12
14
16
20
22
30
32
40
42
44
50
52
54
60
62
64
66
70
72
74
76
77
78
80
84

INSULATING BLANKET FOR SHIPPING CONTAINER HAVING SCORED MINERAL WOOL

TECHNICAL FIELD

The present invention relates to insulated containers, and more particularly relates to a tamper proof shipping container having insulation material configured to provide for improved temperature maintenance of items placed within the container.

BACKGROUND ART

Fresh and frozen food items are shipped worldwide by food suppliers. The fishing industry is one food supplier which ships tremendous quantities of fresh and frozen fish. The fish are often shipped from remote locations in areas such as Alaska to virtually every corner of the world. To preserve the quality of the fish, great care must be taken to avoid spoilage. Warm temperature contributes greatly to spoilage. Salmon in particular is one delicacy which must be handled with great care to preserve its delicate flavor. Thus, in shipping salmon, it is important to maintain frozen fish at a temperature at or below 32° F. and fresh fish at a temperature of between 33° F. and 38° F. It is also important to prevent the fish from either drying out or sitting in water.

Fish are shipped in many types of containers. Many such containers utilize corrugated paperboard in their construction. One version provides a layer of metallized plastic film adhered to the corrugated paperboard. These containers are usually configured to have a top half placed over a bottom half. To help maintain the desired temperature within the container, it is typical for refrigerants such as wet ice, dry ice, or reusable ice packs to be placed within the container. However, even the use of these refrigerants does not consistently maintain the temperature within conventional containers for extended periods of time, such as up to six days under the unrefrigerated conditions often encountered during shipment.

In conventional containers, temperature change is generally attributable to conductive heat transfer between the inner and outer panels of the container, convective air flow into and out of the container, conduction due to condensation formed as the result of ambient air entering the container and contacting the cooler air within the container, and radiant heat transfer. For example, when shipping cold contents, air circulation between the inside of the container and the outside of the container is detrimental to temperature maintenance. Conduction between the inner panels and the outer panels of the container and from condensation can also cause temperature change. In addition to warming both the air and the contents within the container, condensation wets the container material and weakens its structural integrity, degrades the contents, and leaks from the container. Leakage from the container is highly undesirable to air carriers, because the leakage often contains substances corrosive to the airplane. For example, in addition to mess and damage from condensation which is primarily water, the water can also mix with the contents, including salt, blood, and fish slime, to create a highly offensive and corrosive ooze.

It has been suggested to wrap the contents within the container in insulation, such as insulation consisting of mineral wool and paperboard glued together and then glued between a pair of plastic sheets, or to otherwise place insulation within the container to maintain the temperature within the container. This, however, does not inhibit conduction between panels or prevent air from passing into and out of the container. One packaging method uses tape, glue or the like to seal the container such that air is prevented from entering or exiting the container. This, however, does not inhibit conduction between the panels of the container and detracts from the container's ability to be reused. It is also known to provide a metallic or reflective finish on containers to reduce radiant heat transfer. However, these metallic finishes can promote conductive heat transfer if surfaces having a metallic finish are placed in close proximity to other surfaces having a metallic finish.

Thus, there is a need in the art for an improved method for insulating shipping containers and for an improved, reusable insulated shipping container which inhibits the passage of air into and out of the container, inhibits the formation of condensation within the container, prevents liquids from entering into or escaping from the container, decreases conduction between panels of the container, and reduces radiant heat transfer.

SUMMARY OF THE INVENTION

The present invention advances the art by providing an insulated shipping container having improved ability to maintain the temperature of items placed within the container. The present invention minimizes heat transfer by minimizing air and fluid flow between the interior and exterior of the container, by minimizing conduction between components of the container, by reducing the formation of condensation, and by reducing radiant heat transfer.

Generally described, the present invention provides an insulating blanket comprising a pair of liner sheets secured to one another around their periphery; and an insulator positioned within the linear sheets, the insulator having scores formed thereon to define a pair of end sections and a middle section.

More particularly, the present invention provides an insulated container, having a bottom tray comprising a bottom panel having an upwardly facing inner surface and at least two bottom side panels extending upwardly from the bottom panel, each bottom side panel having an outwardly facing surface; a top cover comprising a top panel having a downwardly facing inner surface, and at least two top side panels extending downwardly from the top panel, each top side panel having an inwardly facing surface, the top cover being positioned over the bottom tray such that each inwardly facing surface of the top cover overlaps and faces one of the outwardly facing surfaces of the bottom tray, the overlap of the inwardly and the outwardly facing surfaces defining a pair of channels; and an insulating barrier positioned between the channels and below the inner surface of the top panel, comprising two end sections positioned within the channels, and a middle section positioned between the end sections and between the top panel and the interior of the bottom tray, the barrier comprising, a pair of liner sheets secured to one another around their periphery, and an insulator positioned between the liner sheets, having scores formed thereon positioned to define the end sections and the middle section.

According to a preferred embodiment, the present invention provides an insulated container comprising a bottom tray having at least two bottom side panels and a U-shaped insulating barrier positioned to lie over the bottom tray and along the bottom side panels. The barrier comprises a pair of plastic sheets having a thickness of between about 1 and 4 mil secured to one another around their periphery to define a pouch; a sheet of paper or paperboard having a thickness of between about 6 and 30 mil positioned within the pouch, the sheet of paperboard having scores formed thereon positioned to define the U-shape of said U-shape insulating barrier; and a piece of mineral wool having a density of between 2.5 and 6.0 pounds per cubic foot and a thickness of between ¼ and 1 and ¼ inch positioned within the pouch, the sheet of mineral wool having scores formed thereon positioned to define the U-shape of said U-shaped insulating barrier.

Another aspect of the present invention provides a method of forming an insulating blanket, comprising the steps of placing a sheet of insulation between two plastic sheets; sealing the plastic sheets together around the sheet of insulation; and engaging the plastic sheets and the sheet of insulation with at least one blunt elongate bar to form a score in the sheet of insulation, either prior to, at the same time as, or following the sealing step.

Thus, it is an object of the present invention to provide an improved insulating blanket.

It is another object of the present invention to provide an insulated shipping container utilizing a blanket having a scored insulator and a scored stiffener sealed between a pair of liner sheets.

It is yet another object of the present invention to provide an insulated shipping container which minimizes heat transfer by minimizing air and fluid flow between the interior and exterior of the container, by minimizing conduction between components of the container, by reducing the formation of condensation, and by reducing radiant heat transfer.

It is still another object of the present invention to provide an insulated shipping container having a U-shaped blanket, comprised of scored mineral wool and scored paperboard sealed within a plastic pouch, positioned between channels formed by overlapping side panels.

It is yet another object of the present invention to provide a method of forming an insulating blanket by scoring an insulator positioned between a pair of plastic sheets.

Other objects, features, and advantages of the present invention will become apparent upon reading the following specification when taken in conjunction with the drawings and appended claims.

DETAILED DESCRIPTION OF PREFERRED EMBODIMENTS

Figures 1, 2:
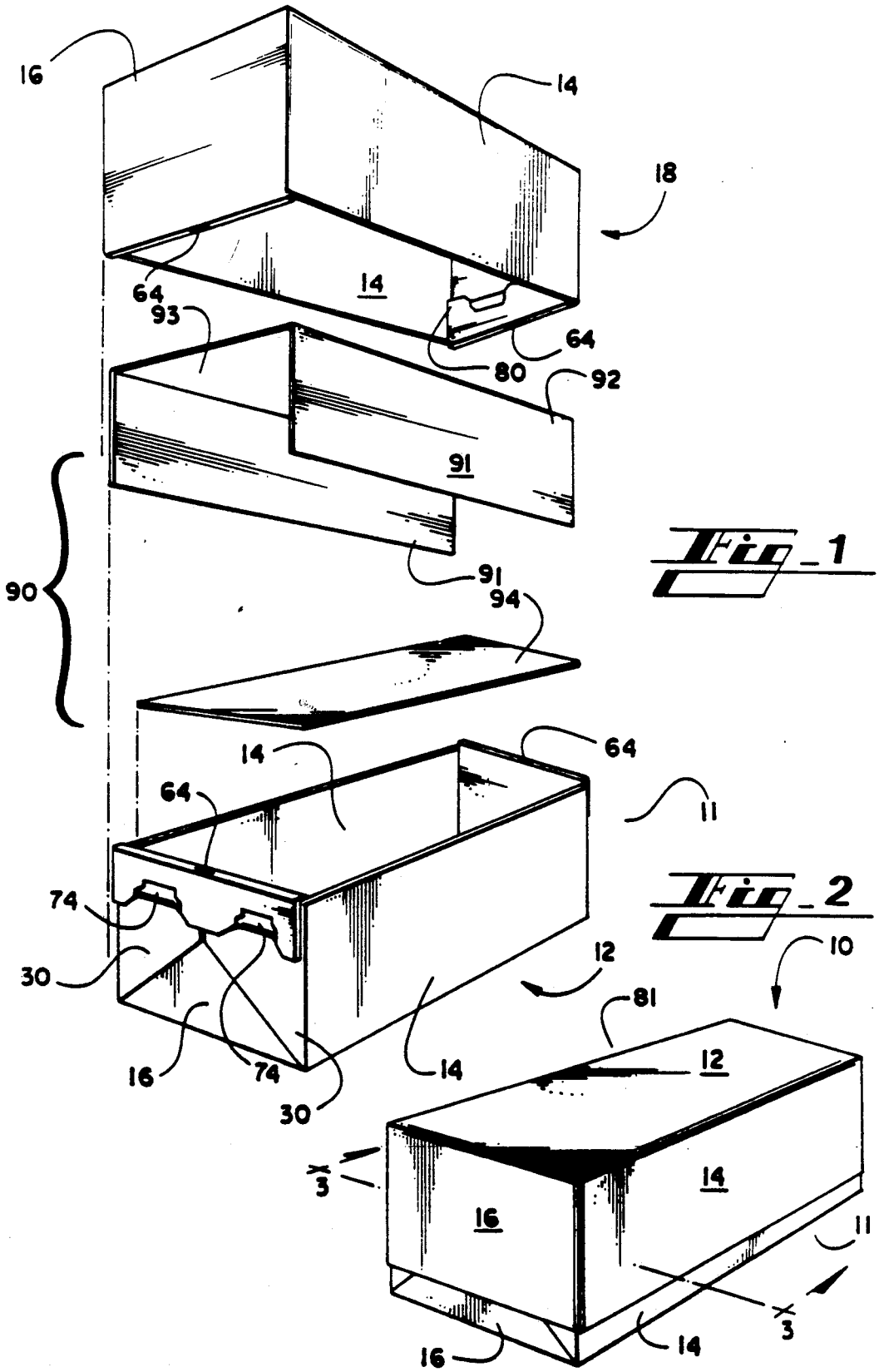
FIG. 1 is a pictorial exploded view of a preferred embodiment of an insulated container according to the invention.
FIG. 2 is a pictorial view of a preferred embodiment of an enclosed insulated container according to the invention.

Referring now in more detail to the drawings, in which like numerals refer to like parts through the several views, FIG. 1 is an exploded view of an insulated container 10. The container 10 includes a bottom tray 11, a cover 81, and a two-piece insulating barrier 90 having an interior pouch 94 and a U-shaped blanket 92.

BOTTOM TRAY AND COVER

Figure 6:
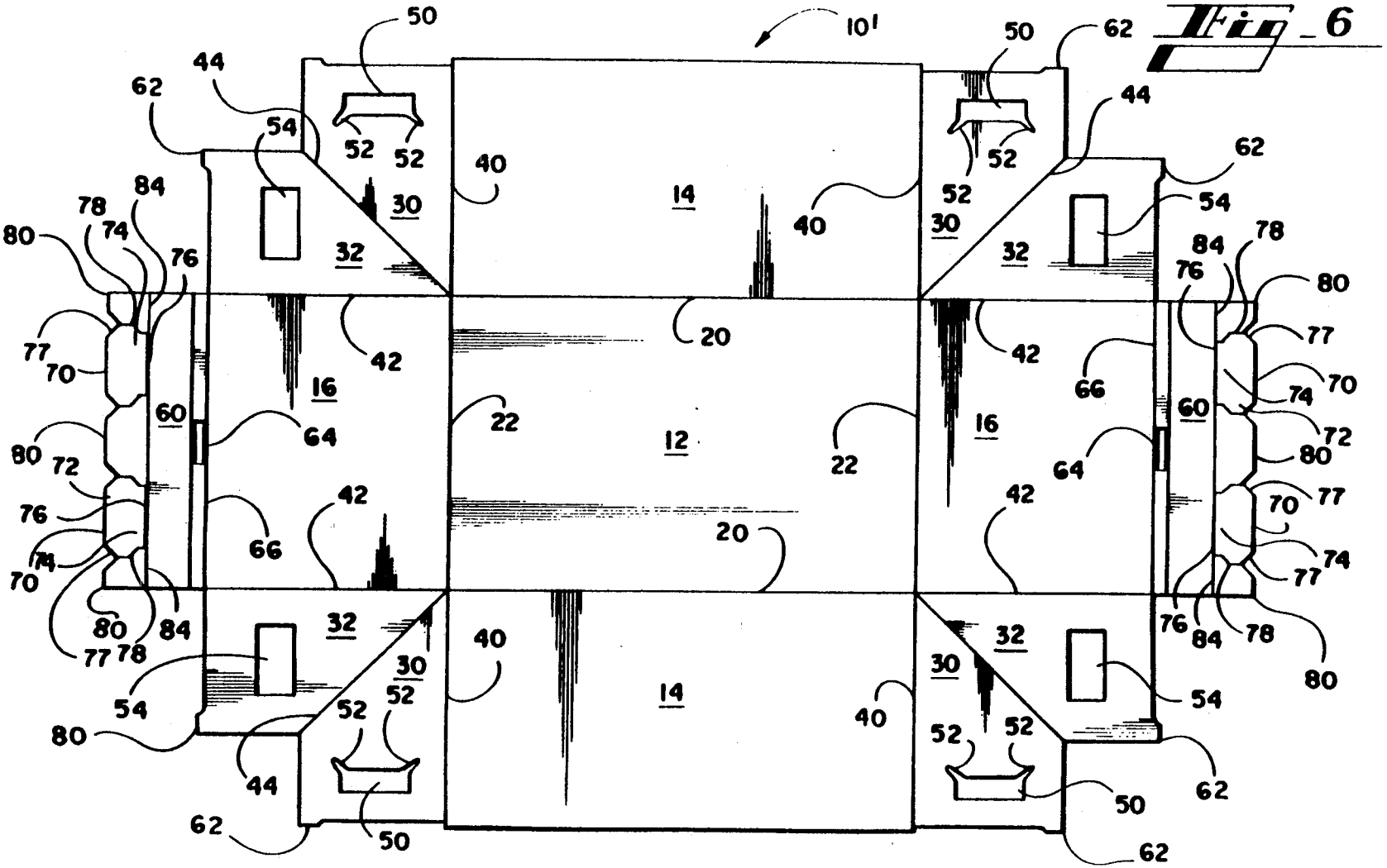
FIG. 6 is a top plan view of a blank used to construct the bottom tray and cover of a preferred embodiment of the invention.

The bottom tray 11 and the cover 81 are preferably constructed such that the assembled container remains assembled independent of secondary securing devices such as tape, glue or twine. The preferred construction is shown in U.S. patent application Ser. No. 449,597, filed Dec. 12, 1989. Referring to FIG. 6, the bottom tray is preferably assembled using a blank 11'. In this preferred construction, the bottom tray includes a bottom panel 12 in the center of the blank 11'. A pair of side panels 14 are foldably connected to opposite sides of the bottom panel 12 along scores or fold lines 20. A pair of end panels 16 are foldably connected to the other opposite sides of the bottom panel 12 along scores 22. A connecting panel 30 is foldably connected along each of a plurality of scores 40 to each end of each of the side panels 14. An additional connecting panel 32 is foldably connected along each of a plurality of scores 42 to each end of each of the end panels 16. Each connecting panel 30 is foldably connected along scores 44 to the connecting panel 32 adjacent to each of the connecting panels 30. A retention tab 62 extends upwardly from each upper edge of the connecting panels 30 and 32 and extends into a retention opening 64 as described below.

Each of the connecting panels 30 defines a first opening 50 therethrough into which a locking tab 70, described below, is inserted. To help each locking tab 70 enter into and be secured within each first opening 50, the first opening 50 is preferably rectangular in shape and defines angled slots 52 extending from the lower corners of the rectangle. Each of the connecting panels 32 defines a second opening 54 therethrough, at least partly overlapping the first opening 50 when the tray 11 is erected. Each second opening 54 is preferably rectangular in shape to provide clearance to help the locking tab 70 slide into the first opening 50.

Extending upwardly from and foldably connected along scores 66 to the upwardly extending edges of each of the end panels 17 is a retention panel 60. Each retention panel 60 is shaped to cover, when the tray 11 is erected, the area of each connecting panel 30 which extends upwardly from the first opening 50 to the upper edge of the connecting panel 30. Each retention panel 60 defines a pair of locking tabs 70, which are slidably inserted into the first openings 50. The locking tabs 70 each have a head portion 72 extending outwardly from a neck portion 74, with the neck portion 74 foldably connected to the outermost horizontal edge of the retention panels 60, along scores 76. The head portion 72 of each locking tab 70 is wider than the first openings 50 and has a plurality of bevelled corners 77 positioned to pass into the slots 52. The head portion 72 also defines a plurality of angled edges 78 positioned to be trapped by the slots 52 when the head portion 72 is inserted into the first opening 50. Each of the scores 66 defines a retention opening 64 along a portion of each of the scores 64, into which the retention tabs 62 extend.

Extending from the retention panels 60 and located adjacent to the locking tabs 70 are tamper tabs 80, positioned so that an unexposed surface 82 of each of the tamper tabs 80, faces each of the connecting panels 30 when the tray 11 is erected. The tamper tabs 80 are foldably connected to the retention panels 60 along scores 84.

To assemble the blank 11' into the tray 11, the side panels 14 may be raised relative to the bottom panel 12 by folding about the scores 20. Simultaneously, folds may be made about the scores 22, 40, 42 and 44, raising the connecting panels 30 and 32 and the end panels 16, respectively. As will be apparent to one skilled in the art, folding about the scores 40 and 42 may be made to orientate the connecting panels 30 and 32 either within or exterior to the raised side panels 14 and end panel 16. The connecting panels 30 and 32 may be folded about the scores 46 such that each connecting panel 32 is parallel to and in contact with either the exterior or interior face of each end panel 16. When the connecting panels are positioned exterior to the end panel 16, one face of the connecting panel 30 is parallel to and in contact with the connecting panel 32 and the other face of the connecting panel 30 is exposed. The same folding action brings the retention tabs 62 on adjacent panels 30 and 32 into alignment.

It will be seen that the tray 11 may be formed using locking tabs as described above while utilizing only connecting panels 30, or only connecting panels 32, or a combination thereof. It will further be seen that connecting panels 30 and 32 are not required to be foldably connected along scores 44.

To form the tray 11 the connecting panels are folded exterior to the side and end panels. Then the adjacent connecting panels are folded toward the end panels 16. The connecting panels 32 are then oriented parallel to and in contact the exterior face of end panel 16. The retention panels 60 may then be folded about the scores 66 downwards against the connecting panels 30 and 32 with the aligned pairs of retention tabs 62 contained within the retention openings 64. When the retention panels 60 are folded against the connecting panels 30 and 32, the head portion 72 of the locking tabs 70 may be inserted into the first opening 50, so that the bevelled corners 76 pass through the slots 52, and the edges 78 lock in the slots 52. The second opening 54 provides clearance to help the head portion 72 slide into the first opening 50. When fully inserted the locking tabs 70 will remain locked in the slots 52 unless the tabs are manipulated intentionally to allow them to pass back through the slots, which may be done to disassemble the container. When all four locking tabs 70 are inserted into the slots 52, the tray is erected and ready for loading. This locking arrangement not only maintains closure, but also provides a leak proof tray by utilizing seamless construction. The tray 11 may be repeatedly disassembled and assembled.

As will be apparent to one skilled in the art, the retention panels 60 may alternatively be foldably connected to the side panels 14 and the connecting panels 30 and 32 may be folded against the side panels, so that the retention panels fold down over the side panels to allow insertion of the locking tabs 70.

As previously explained, the connecting panels 30 and 32 may be folded against either the interior or exterior of the end wall. A container cover 81 shown in FIG. 1 formed in the same manner as the tray 11, is made by positioning the connecting flaps 30 and 32 interior to the side and end panels. The cover 81 may then be placed over the tray 11 and the insulating barrier 90 to form an enclosed container 10 as is shown in FIG. 2, and explained further below. The above steps may be reversed when disassembly is required, with the unassembled blanks being space efficient and readily reassembled.

It is also desirable that a metallized plastic film or foil/plastic laminate layer be disposed on the exterior and interior surfaces of the paperboard blank 11', as is well known in the art. Preferably the plastic surface is positioned to the exterior of the metal layer. However, to avoid metal-to-metal proximity which readily conducts heat between the adjacent components, the metallized layer preferably is not provided for surfaces of the container which immediately abut other similarly prepared surfaces of the container. For example, metallization may be omitted from the inner top sidewall panels and the outer bottom sidewall panels when a metallized blanket (described below) is utilized.

INSULATING BARRIER

Referring to FIG. 1., the preferred two-part insulating barrier 90 includes the blanket 92 comprised of two end sections 91 and a middle section 93, and the interior pouch 94. While it is preferred to include the interior pouch 94, the improved thermal integrity of the insulated container 10 is due primarily to the ability of the blanket 92 to minimize conductive and convective heat transfer, as discused below.

To install the insulating barrier 90, the interior pouch 94 is placed along the bottom panel 12. The blanket 92 is then placed over and around the tray 11, so that the exterior surfaces of the bottom side panels face a side of the U-shaped blanket, as will be discussed further. To form the enclosed container 10, the cover 81 is positioned over the thus assembled tray 11 and insulating barrier 90 such that each outwardly facing surface of the blanket 92 faces an interior surface of the cover 81 and is positioned within a pair of channels 112 defined between these facing surfaces, as shown in FIG. 3.

Turning to the construction of the barrier 90, the two embodiments below provide examples of insulation materials suitable for many purposes. The below descriptions refer to the construction of embodiments of the blanket 92. It will be understood, however, that similar embodiments of the pouch 94 may be constructed and placed along the bottom of the tray 11 to complete the barrier 90 and provide additional insulation.

Figure 3:
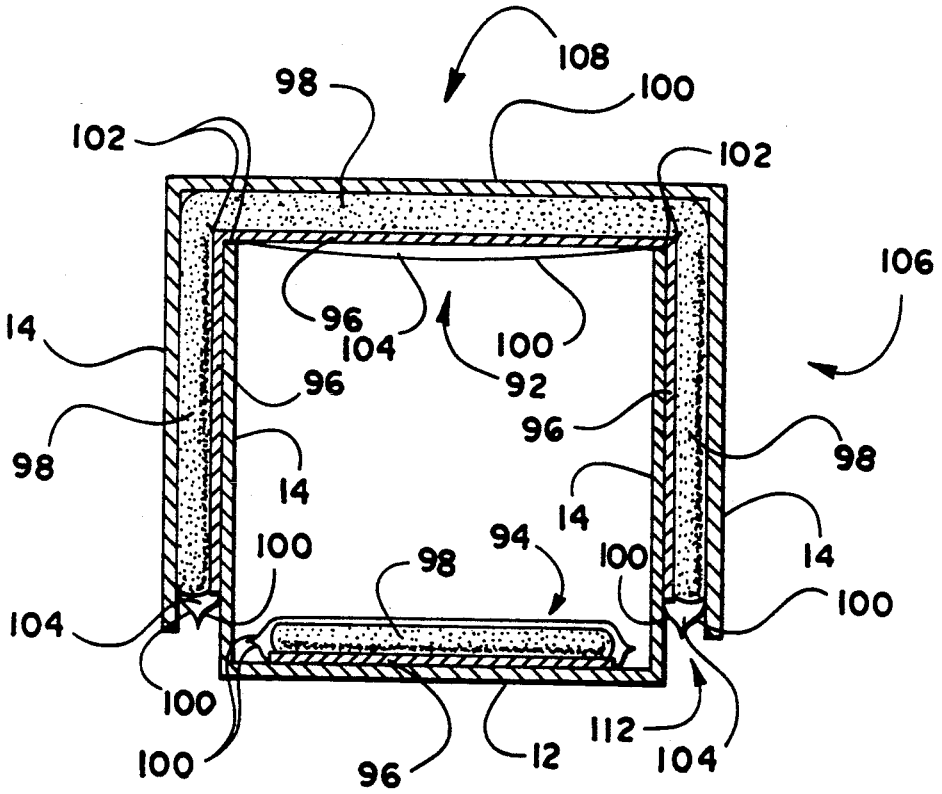
FIG. 3 is a horizontal cross-sectional view of the insulated container taken along line 3—3 of FIG. 2, showing the position of a preferred embodiment of the insulating barrier in the enclosed container of the present invention.
Figure 4:
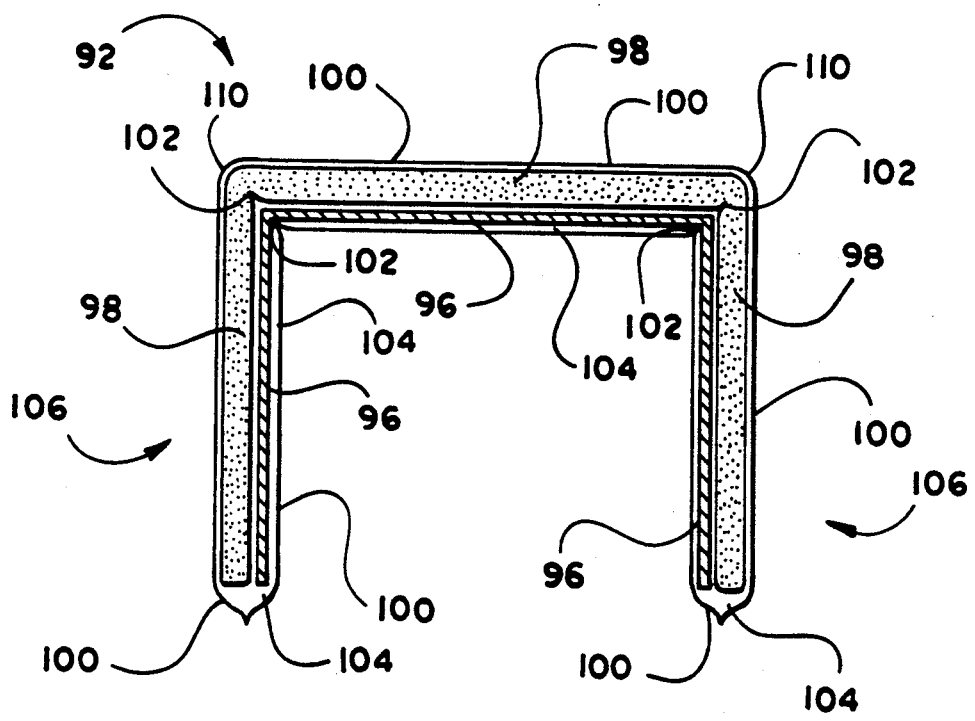
FIG. 4 is a horizontal cross-sectional view showing the construction of a preferred embodiment of the insulating blanket.
Figure 7:
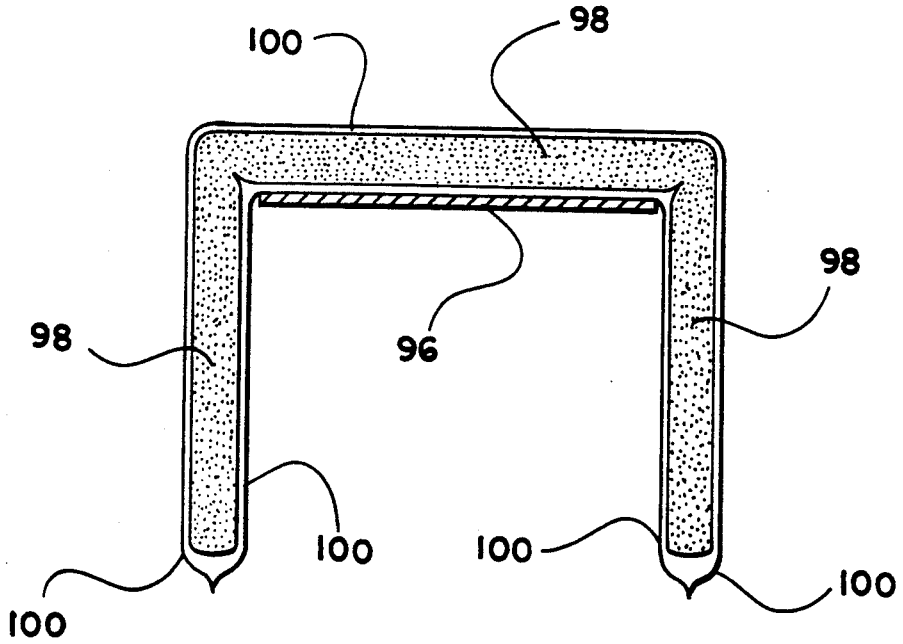
FIG. 7 is a horizontal cross-sectional view showing the construction of yet another alternate embodiment of the present invention.
Figure 8:
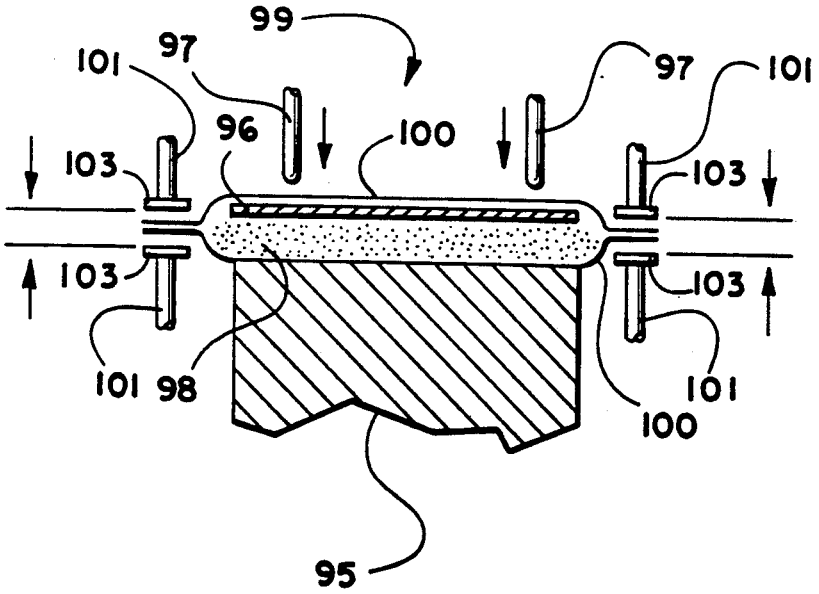
FIG. 8 is a diagrammatic cross-sectional view of an apparatus for scoring insulation and sealing plastic sheets.

Referring to FIGS. 3 and 4, there is shown a preferred embodiment of the blanket 92. The blanket 92 is a U-shaped blanket preferably constructed by sandwiching a stiffener 96 and an insulator 98 between a pair of plastic sheets 100, with the insulator and stiffener being crushed to form scores 102. It is preferable to crush the mineral wool and stiffener using elongate bars. In this manner, the mineral wool and stiffener may be crushed from each side to a midpoint or from only one side to a depth sufficient to allow reasonable flexibility for folding. A scoring and sealing apparatus 99, shown in FIG. 8, may be utilized to score the insulator 98, and/or stiffener 96, and seal the plastic sheets 100. The apparatus 99 includes a base 95, a pair of blunt, elongate bars 97 positioned to coincide with the intended scores 102, and a pair of heat sealing bars 101 each having a flat surface 103. The bars 97 and 101 are vertically manipulated, preferably hydraulically, in the direction of the arrows to crush the insulator to form the scores 102 and to seal the plastic sheets 100 together around their periphery. The mechanical aspects of such a machine will be well known and apparent to one skilled in the art. Several different methods of operating the apparatus 99 are possible. For example, the stiffener and the insulator may both be scored once they are sealed within the plastic sheets or during the sealing process. Alternately, the mineral wool or the stiffener or both may be scored prior to their placement between the sheets. It will also be noted that because the primary purpose of the stiffener is to increase the puncture resistance of the blanket and to more evenly distribute weight, the stiffener may be omitted. Also, because puncture resistance and load distribution is important primarily for the middle section 93 of the blanket, one or more stiffeners may be utilized in only the middle section (or whichever section or sections it is necessary to provide such protection). Likewise, one or more stiffeners could alternately or additionally be bonded to the exterior of the plastic sheets, as shown in FIG. 7. It will also be noted that the insulator and stiffener need not be adhered to one another. This feature is especially adapted for recycling programs because the individual pieces may easily be removed for recycling.

The plastic sheets 100 need not be adhered to one another or otherwise altered in the area of the scores 202. The sheets 100 are sealed to one another along their peripheral edges, preferably by heat sealing or by use of an adhesive. This provides a single pouch 104, having a U-shaped configuration. The scores 102 delineate the blanket into two end sections 106 and a middle section 108. Because the plastic sheets 100 are not adhered to one another along the scores 102, a vented seam 110 is provided between each end section 106 and the middle section 108. One skilled in the art will appreciate that the seams 110 are held tightly by the cover along the upper edges of the bottom side walls 14 of the tray 11. This provides a tight, gasket like seal along the upper edges of the bottom side walls of the tray to provide even greater protection from convective heat transfer. Preferred construction materials are shown in Table 1:

TABLE 1

| Component | Material |
|---|---|
| Stiffener | Paperboard having a thickness of about 6 and 30 mil (between about 6 and 30 point chip board). |
| Insulation | Mineral wool, having a density of between 2.5 and 6.0 pounds per cubic foot and a thickness of between ¼ and 1 and ¼ inch. |
| Plastic sheets | Polyethylene, having a thickness of between 1 and 4 mil; coated with a reflective finish on the exterior surfaces, such as aluminum having a thickness of between 90 and 110 Angstroms applied using a standard technique such as vacuum deposition. |

The stiffener 96 makes a smaller contribution to the insulation properties of the blanket 92, than does the insulator 98. As stated above, the stiffener adds primarily to the puncture resistance of the blanket and serves to more evenly distribute weight to prevent point compression of the insulator 98. Additionally, each stiffener may be glued to each insulator, preferably with edible, fast drying, water soluble glues, to improve handling qualities. To further enhance insulating qualities, it will also be understood that a metallic or reflective finish may be provided on the surfaces of the blanket 92, such as by vacuum deposition, to reduce radiant heat transfer. However, if the inner surfaces of the tray 11 and cover 81 are metallized, it is preferably not to metallize the blanket 92 in order to avoid metal-to-metal proximity.

The blanket 92 is shown positioned between the tray 11 and the cover 81, such that the blanket 92 covers the top of the tray 11 and extends into channels 112 formed by the side panels 14 when the cover 81 is placed over the tray 11. Thus, the blanket 92 should be configured to conform closely to the top of the tray 11 and to be pressed between the panels 14 in the channels 112. The sheet 92 of corrugated board is shown positioned along the bottom of the tray 11 to complete the barrier and provide additional insulation.

As shown in FIG. 3, the blanket 92 as installed substantially occupies the channels 112 and prevents the side panels 14 of the cover 81 from contacting the side panels 14 of the tray 11. In this manner, heat transfer attributable to convection and conduction are minimized.

Convection is the transfer of heat by the circulation of fluids, i.e., such as air flow through the channels 112. Conduction is the transfer of heat between two parts of a stationary system, i.e., such as between the top and bottom side panels 14, caused by a temperature difference between the two parts. Convection is minimized because the blanket 92 effectively blocks air flow through the channels 112 between the interior of the container 10 and the environment. The end panels 16 of the tray 11 and cover 81 are smaller than the side panels 14 and do not provide as large a channel area for convection. Additionally, because of the construction of the end panels 16, they tend to press against one another at the ends, so that air flow is minimal, and additional insulation to protect against convective heat transfer may be omitted.

The blanket 92 also separates the side panels 14 of the tray 11 and the cover 81, and provides a barrier to heat conduction between these panels which could result because of the temperature difference between the interior and exterior of the container. Conduction through the end panels 16 is not a significant problem, primarily because of the small surface area of the end panels and because of dead air space between the end panels 16 of the tray 11 and the cover 81 created by the end construction. Because of these considerations, and to permit the preferred end construction, the end panels 16 of the container are not insulated further. It should be understood however, that of the blanket 92 could be extended between the channels formed between the end panels. By minimizing convection and conduction, as described above, condensation is also discouraged from forming.

Figure 5:
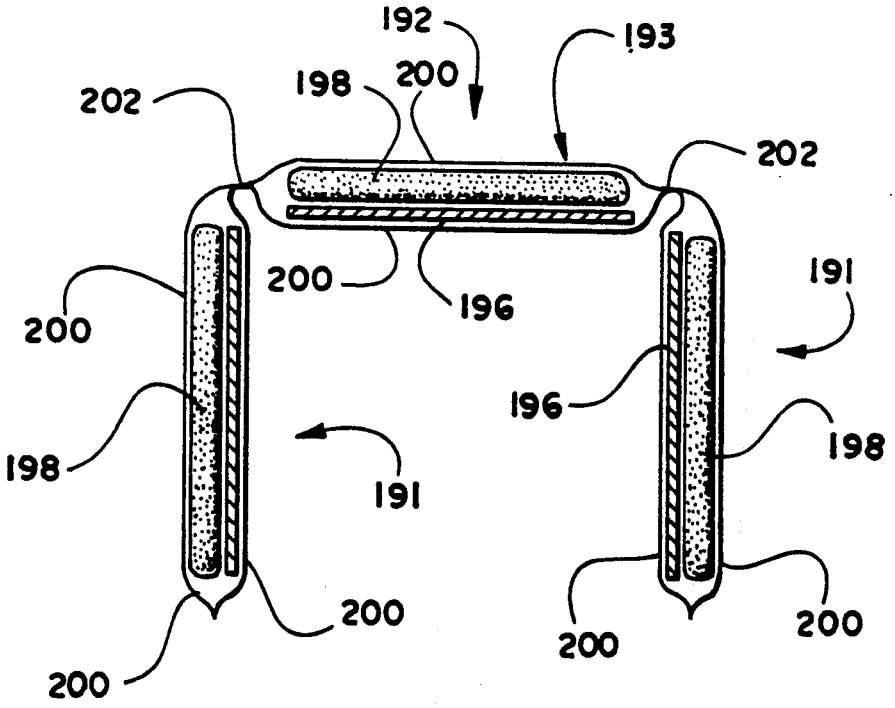
FIG. 5 is a horizontal cross-sectional view showing the construction of an alternate embodiment of the insulating blanket.

An alternate embodiment of the insulating blanket 192, is shown in FIG. 5. Referring to FIG. 5, the blanket 192 may be constructed by sandwiching three sheets of a stiffener 196 and three sheets of an insulator 198 between a pair of plastic sheets 200. The same materials as shown in Table 1 may be utilized except that three sheets of the stiffener 196 and insulator 198 are utilized. The plastic sheets 200 are sealed around their periphery and along a pair of seams 202 to form a pair of end sections or pouches 191 and a middle pouch 193. A set consisting of one of the sheet stiffener 196 and one sheet of the insulator 198 is inserted into each of the pouches prior to enclosure of the pouches. The seams 202 are sealed seams which prevent air from passing from one pouch to another and thereby reduces convective heat transfer between pouches. Additionally because the individual sheets of stiffener 196 and insulation 198 are not continuous between the pouches 191 and 193 of the blanket 192, heat does not conduct directly through the stiffener and insulation of one pouch to the stiffener and insulation of another pouch.

In the embodiments shown in FIGS. 4 and 5, the volume of the blankets 92 and 192 may be reduced by removing air from between the plastic sheets. Removal of the air preferably is accomplished by applying a vacuum between the plastic sheets when sealing the plastic sheets, or by compressing the mineral wool to force out trapped air when sealing the plastic sheets, and allowing the mineral wool to expand once sealing is accomplished.

The foregoing description relates to preferred embodiments of the present invention, and modifications or alterations may be made without departing from the spirit and scope of the invention as defined in the following claims.

We claim:

1. An insulated container, comprising:

(A) a bottom tray, comprising:

(i) a bottom panel having an upwardly facing inner surface; and (ii) at least two bottom side panels extending upwardly from said bottom panel, each bottom side panel having an outwardly facing surface;

(B) a top cover, comprising:

(i) a top panel having a downwardly facing inner surface, and (ii) at least two top side panels extending downwardly from said top panel, each top side panel having an inwardly facing surface, (iii) said top cover being positioned over said bottom tray such that each inwardly facing surface of said top cover overlaps and faces one of said outwardly facing surfaces of said bottom tray, the overlap of said inwardly and said outwardly facing surfaces defining a pair of channels; and (C) an insulating barrier positioned between said channels and below said inner surface of said top panel, comprising two end sections positioned within said channels, and a middle section positioned between said end sections and between said top panel and the interior of said bottom tray, said barrier comprising, (i) a pair of liner sheets secured to one another around their periphery, and (ii) an insulator positioned within said liner sheets, said insulator having scores formed thereon positioned to define said end sections and said middle section.

2. The container of claim 1 wherein said barrier further comprises a stiffener positioned between said liner sheets having scores formed thereon positioned to define said end sections and middle section.

3. The container of claim 2, wherein said barrier further comprises an insulating pouch positioned along said inner surface of said bottom panel.

4. The container of claim 2, wherein said insulator is positioned between said stiffeners and an inner surface of one of said liner sheets.

5. The insulated container of claim 2, wherein said top cover urges said insulating barrier against upwardly facing edges of said bottom side panels.

6. The container of claim 2, wherein said insulating barrier has a reflective finish on at least one surface.

7. The container of claim 2, wherein said stiffener comprises a sheet of paperboard having scores thereon.

8. The container of claim 1, wherein said insulator comprises a sheet of mineral wool having scores thereon.

9. An insulated container, comprising:

(A) a bottom tray having a pair of upwardly extending bottom side panels, each of said bottom side panels defining an outwardly facing surface;

(B) an insulating barrier having a pair of end sections and a middle section, positioned to extend over the bottom tray and downwardly over said outwardly facing surfaces of said bottom tray, said barrier comprising (i) a pair of liner sheets having facing surfaces and secured to one another around their periphery, (ii) a stiffener positioned between said liner sheets, said stiffener having scores formed thereon corresponding to said end sections and said middle section, and (iii) an insulator positioned between said liner sheets, said insulator having scores formed thereon corresponding to said end sections and said middle section; and (C) a cover having a pair of downwardly extending cover side panels, each of said cover side panels defining an inwardly facing surface, portions of said barrier being pressed between said cover side panels and said bottom side panels.

10. An insulated container, comprising:

a bottom tray having at least two bottom side panels;

an insulating barrier having a U-shape positioned to lie over said bottom tray and along said bottom side panels said barrier comprising:

(i) a pair of liner sheets having facing surfaces and secured to one another around their periphery;

(ii) a stiffener positioned between said liner sheets, said stiffener having scores formed thereon such that said stiffener may be foldably configured in said U-shape, and (iii) an insulator positioned between said liner sheets, said insulator having scores formed thereon such that said insulator may be foldably configured in said U-shape; and a cover having at least two top side panels, said cover being positioned to retain said barrier between said bottom side panels and said top side panels.

11. The container of claim 10, wherein said stiffener comprises a paperboard sheet having a thickness of between about 6 and 30 mil.

12. The container of claim 11, wherein said insulator comprises mineral wool having a density of between 2.5 and 6.0 pounds per cubic foot and a thickness of between ¼ and 1 and ¼ inch.

13. The container of claim 12, wherein said liner sheets comprises plastic sheets having a thickness of between about 1 and 4 mil.

14. The container of claim 13, wherein said plastic sheets have a reflective finish on at least one of their outer surfaces.

15. The container of claim 14, wherein said barrier extends substantially the length and height of said bottom side panels.

16. The container of claim 10, further comprising a bottom insulator sheet positioned along an inner surface of said bottom tray.

17. The container of claim 16, wherein said bottom insulator sheet comprises:

(i) a pair of liner sheets having facing surfaces and secured to one another around their periphery to define a bottom pouch, and (ii) an insulator positioned within said bottom pouch.

18. The container of claim 17, further comprising a stiffener positioned within said bottom pouch.

19. The container of claim 18, wherein said bottom insulator sheet has a reflective finish on at least one of its surfaces.

20. The container of claim 19, wherein said bottom insulator sheet extends over substantially all of said inner surface of said bottom tray.

21. An insulated container, comprising:

a bottom tray having at least two bottom side panels;

a U-shaped insulating barrier positioned to lie over said bottom tray and along said bottom side panels, said barrier comprising:

(i) a pair of plastic sheets having a thickness of between about 1 and 4 mil secured to one another around their periphery, to define a pouch, (ii) a sheet of paper or paperboard having a thickness of between about 6 and 30 mil positioned within said pouches, said sheet of paper or paperboard having scores formed thereon positioned to define the U-shape of said U-shaped insulating barrier, (iii) a sheet of mineral wool having a density of between 2.5 and 6.0 pounds per cubic foot and a thickness of between $\frac{1}{4}$ and $1\frac{1}{4}$ inch positioned within said pouch, said sheet of mineral wool having scores formed thereon positioned to define the U-shape of said U-shaped insulating barrier.

22. An insulating barrier, comprising:

(i) a pair of liner sheets secured to one another around their periphery;

(ii) an insulator positioned within said liner sheets, said insulator having scores formed thereon positioned to define a pair of end sections and a middle section; and (iii) at least one sheet of a stiffener attached to the exterior of at least one of said liner sheets.

* * * * *